US011065664B2

(12) United States Patent
Fujita et al.

(10) Patent No.: US 11,065,664 B2
(45) Date of Patent: Jul. 20, 2021

(54) METAL SHEET MOLDING METHOD

(71) Applicant: HONDA MOTOR CO., LTD., Tokyo (JP)

(72) Inventors: Masaaki Fujita, Tochigi-ken (JP); Ugeun Shin, Tochigi-ken (JP); Hiroshi Matsui, Tochigi-ken (JP); Kazuma Fujiwara, Tochigi-ken (JP); Kuniaki Akutsu, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 149 days.

(21) Appl. No.: 16/364,341

(22) Filed: Mar. 26, 2019

(65) Prior Publication Data

US 2019/0299271 A1 Oct. 3, 2019

(30) Foreign Application Priority Data

Mar. 27, 2018 (JP) ..... JP2018-059257

(51) Int. Cl.
*B21D 28/14* (2006.01)
*B21D 37/10* (2006.01)
*B21D 31/00* (2006.01)

(52) U.S. Cl.
CPC ..... *B21D 28/14* (2013.01); *B21D 31/005* (2013.01); *B21D 37/10* (2013.01)

(58) Field of Classification Search
CPC ..... B21D 28/06; B21D 28/10; B21D 28/14; B21D 28/22; B21D 31/005; B21D 35/003;

(Continued)

(56) References Cited

U.S. PATENT DOCUMENTS 6,427,512 B2 * 8/2002 Suzuki ..... B21D 53/14 72/327
6,453,716 B2 * 9/2002 Suzuki ..... B21D 53/14 72/329

(Continued)

FOREIGN PATENT DOCUMENTS

CN 102655962 9/2012
JP 2006-183850 A * 7/2006 ..... B21D 53/14

(Continued)

OTHER PUBLICATIONS

Chinese Office Action and Search Report for Chinese Patent Application No. 201910238231.9 dated Apr. 21, 2020.

(Continued)

*Primary Examiner* — Edward T Tolan
(74) *Attorney, Agent, or Firm* — Amin, Turocy & Watson, LLP

(57) ABSTRACT

A machining surface of a die are provided with a pair of inclined surfaces facing each other across a gap and a flat surface interposed therebetween. Each inclined surface includes an inner end portion on a side near the flat surface and an outer end portion on a side farther away from the flat surface. The molding method includes a mounting step of mounting the metal sheet on the die to span both inclined surfaces, and a pressing step of forming a reduced-thickness portion by pressing the metal sheet between the punch and the inclined surfaces of the die. The pressing step includes setting a bottom dead center of the punch to maintain a gap formed between the inner end portion and a surface of the metal sheet facing the inner end portion.

2 Claims, 9 Drawing Sheets

(58) Field of Classification Search
CPC ..... B21D 35/006; B21D 53/14; B21K 23/02; B21K 27/04; B21J 5/02; B21J 13/02
See application file for complete search history.

(56) References Cited

U.S. PATENT DOCUMENTS

| | | | | |
|---|---|---|---|---|
| 6,742,373 | B2 * | 6/2004 | Wakui | B21D 53/14 72/327 |
| 6,904,782 | B2 * | 6/2005 | Suzuki | B21D 53/14 72/329 |
| 6,951,124 | B2 * | 10/2005 | Kanamaru | B21D 53/14 474/242 |
| 9,192,974 | B2 * | 11/2015 | Okubo | B21D 35/001 |
| 9,327,339 | B2 * | 5/2016 | Kakiuchi | B21D 53/14 |
| 9,630,229 | B2 | 4/2017 | Hirata et al. | |
| 10,591,021 | B2 * | 3/2020 | Sumida | F16G 5/16 |
| 2001/0049314 | A1 | 12/2001 | Suzuki | |

FOREIGN PATENT DOCUMENTS

| | | | | |
|---|---|---|---|---|
| JP | 2012-157871 | | 8/2012 | |
| JP | 2016-124020 | | 7/2016 | |
| WO | 03/069185 | A1 * | 8/2003 | B21D 53/14 |
| WO | 2014/175389 | | 10/2014 | |

OTHER PUBLICATIONS

Chinese Office Action and Search Report for Chinese Patent Application No. 201910238231.9 dated Nov. 30, 2020.

* cited by examiner

METAL SHEET MOLDING METHOD

CROSS-REFERENCE TO RELATED APPLICATION

This application is based upon and claims the benefit of priority from Japanese Patent Application No. 2018-059257 filed on Mar. 27, 2018, the contents of which are incorporated herein by reference.

BACKGROUND OF THE INVENTION

Field of the Invention

The present invention relates to a molding method of a metal sheet that can realize a molded item having a reduced-thickness portion where the thickness is reduced, by applying crush machining to the metal sheet.

Description of the Related Art

A continuously variable transmission (CVT) element includes a head positioned on the outer circumferential side of a continuously variable transmission belt and a body positioned on the inner circumferential side of the continuously variable transmission, when forming the continuously variable transmission belt, as well as a neck connecting the head and the body. The body is provided with a thinned portion where the thickness becomes continuously smaller from the outer circumferential side toward the inner circumferential side. A molded item including the reduced-thickness portion where the thickness is reduced more than at other locations, such as in the continuously variable transmission element having the thinned portion, can be obtained by applying crush machining using a punch and a die to the metal sheet, for example (see Japanese Laid-Open Patent Publication No. 2012-157871, for example). With this crush machining, the metal sheet is pressed between the bottom end surface of the punch and the machining surface of the die provided with a flat surface and an inclined surface. In this way, a portion (also referred to below as an "inclined surface contact portion") sandwiched between the inclined surface of the die and the bottom end surface of the punch is pressed, thereby forming the reduced-thickness portion in the metal sheet after the crush machining.

SUMMARY OF THE INVENTION

In crush machining such as described above, when the die and the punch are clamped, the distance between the inclined surface of the die and the bottom end surface of the punch is different at every region, according to the inclination angle of the inclined surface, and therefore the pressing force applied to the inclined surface contact portion of the metal sheet has a different magnitude at each region. In this case, flowing of matter along the surface direction of the processing surface of the die occurs in the metal sheet, but there is little or no room for the matter to flow between the clamped die and punch, particularly in the surface direction described above from the inclined surface side to the flat surface side. Therefore, due to the matter left with no place to go, uneven thickness and the like occurs in the surface of the metal sheet, and there is a concern that it would be difficult to improve the quality of the resulting molded item.

The main objective of the present invention is to provide a metal sheet molding method capable of restricting uneven thickness and the like occurring in the surface of a molded item including a reduced-thickness portion where the thickness is reduced by applying crush machining to the metal sheet, to obtain a high-quality molded item.

According to an embodiment of the present invention, provided is a molding method of a metal sheet for obtaining a molded item including a reduced-thickness portion where thickness is reduced by applying crush machining to the metal sheet using a punch and a die, wherein a machining surface of the die is provided with a pair of inclined surfaces facing each other across a gap and a flat surface interposed between the pair of inclined surfaces; each inclined surface in the pair includes an inner end portion on a side near the flat surface and an outer end portion on a side farther away from the flat surface, and is inclined in a direction to protrude farther from the flat surface from the inner end portion toward the outer end portion; the molding method comprises a mounting step of mounting the metal sheet on the die in a manner to span both of the inclined surfaces in the pair, and a pressing step of forming a reduced-thickness portion by bringing the die close to the punch and pressing the metal sheet between the punch and each of the inclined surfaces in the pair; and the pressing step includes setting a bottom dead center of the punch in a manner to maintain a state in which a gap is formed between the inner end portion and a surface of the metal sheet facing the inner end portion.

In the metal sheet bonding method, when pressing the metal sheet between the inclined surfaces of the die and the punch in the pressing step, a state is maintained in which a gap is formed between the inner end portions of the inclined surfaces and the metal sheet. Therefore, since the pressing force applied to the portions (inclined surface contact portions) of the metal sheet being pressed between the inclined surfaces of the die and the punch is different in each region according to the inclination angle of the inclined surfaces, even a flow of matter along the surface direction of the machining surface of the die occurs in the inclined surface contact portions, the matter can be made to flow into the gap between the inner end portions of the inclined surfaces and the metal sheet. By making it possible for the matter to favorably flow between the machining surface of the die and punch in this manner, it is possible to avoid the occurrence of uneven thickness or the like in the surface of the metal sheet.

From the above, according to the metal sheet molding method, it is possible to apply the crush machining to the metal sheet while restricting the occurrence of uneven thickness or the like in the surface, and therefore it is possible to obtain a high-quality molded item including reduced-thickness portions.

In the metal sheet molding method, it is preferable that a notched portion in which at least a portion of the inclined surface is notched is formed in each inclined surface from the outer end portion toward the inner end portion, and the mounting step includes mounting the metal sheet on the die such that a location where thick portions, which are thicker than the reduced-thickness portion of the metal sheet, are formed faces the notched portions. In this case, it is possible to form the thick portion, which is thicker than the reduced-thickness portions, in regions of the metal sheet that are not interposed between the punch and the flat surface of the die, i.e. on the side of the metal sheet where the reduced-thickness portions are provided, in the pressing step, using a simple configuration in which the notched portions are provided in the inclined surfaces.

In the metal sheet molding method, it is preferable that the molded item a continuously variable transmission element that includes a body having a thinned portion and a side surface that slides on a rib of a continuously variable transmission, a neck that protrudes from a top end portion of the body, and a head that is wider than the neck and connected to the neck, and sandwiches a metal belt between the body and the head, and that the mounting step and the pressing step include forming the thinned portion as the reduced-thickness portion. This metal sheet molding method can be suitably applied particularly in a case where a continuously variable transmission element is to be obtained. In this way, it is possible to obtain a continuously variable transmission element with excellent quality in which uneven thickness or the like in the surface is restricted.

In the metal sheet molding method, it is preferable that a notched portion in which at least a portion of the inclined surface is notched is formed in each inclined surface from the outer end portion toward the inner end portion, and that the molding method comprises a punching step for punching an outline shape of the continuously variable transmission element in the metal sheet, while leaving behind at least part of thick portions formed to be thicker than the reduced-thickness portion in the pressing step, by mounting the thick portions at a position facing the notched portions in the mounting step.

In this case, it is possible to form the connecting portions, which connects the portion of the metal sheet forming the continuously variable transmission element and the remaining portion of the metal sheet, at the thick portion remaining without being punched in the punching step. At this time, since the thick portion has a sufficient thickness, it is possible to easily form the connecting portions. By severing this connecting portion in the separation step after the punching step, for example, it is possible to separate the continuously variable transmission element from the remaining portion of the metal sheet. In this way, by performing the punching step and the separation step as separate steps, it is possible to obtain the continuously variable transmission element efficiently and with high accuracy.

The above and other objects features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
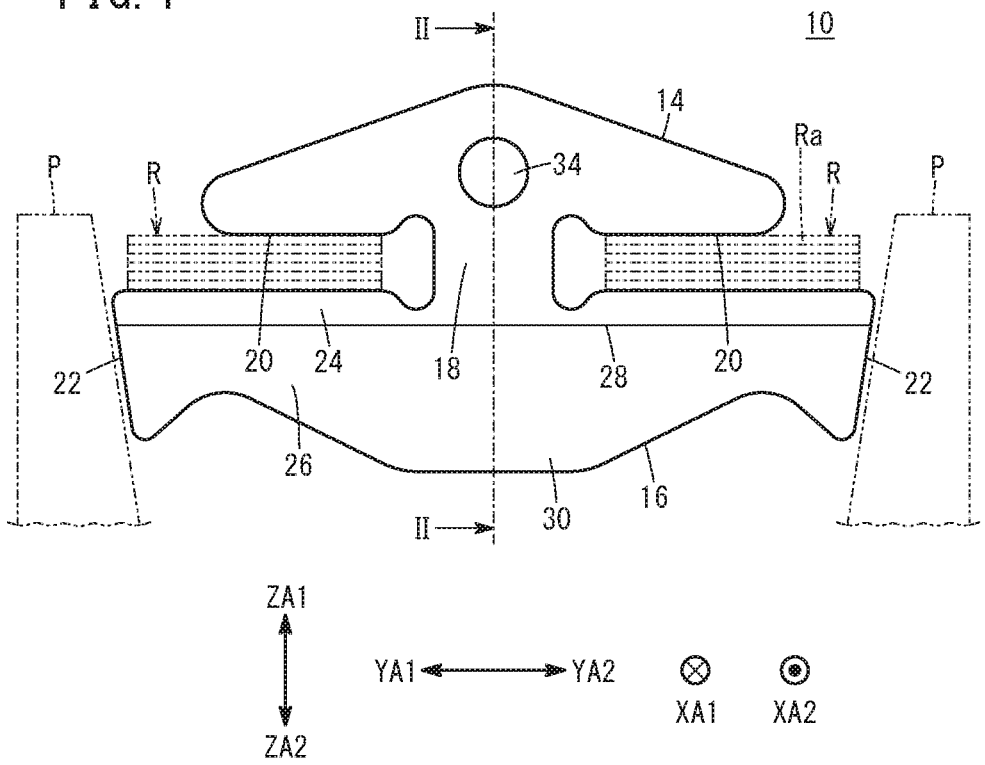
FIG. 1 is a descriptive diagram of the continuously variable transmission element, which is a molded item obtained using the metal sheet molding method according to an embodiment of the present invention.

The following detailed description provides examples of preferred embodiments of a metal sheet molding method according to the present invention, and references the accompanying drawings. In the following drawings, configurational components that realize the same or similar functions and effects are given the same reference numerals, and there are cases where repetitive descriptions are omitted.

Figure 2:
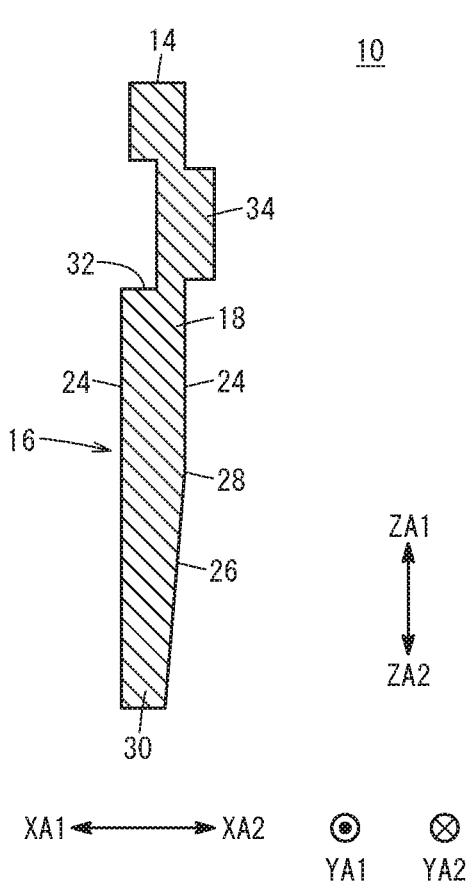
FIG. 2 is a cross-sectional view over the line II-II of FIG. 1.

The metal sheet molding method according to the present embodiment can be favorably applied in a case where a continuously variable transmission element (referred to below simply as an "element") 10 shown in FIG. 1 and FIG. 2 is obtained, for example. The following describes an example in which the element 10 is obtained as a molded item from a metal sheet 12 (see FIG. 3), using the metal sheet molding method according to the present embodiment. However, the molded item obtained using the metal sheet molding method according to the present embodiment is not limited to the element 10, and may be any item that includes a reduced-thickness portion where the thickness is reduced by applying crush machining to the metal sheet 12.

The element 10 is a member forming a continuously variable transmission belt by being bundled into a single body by a metal ring R, in a state where a plurality of elements 10 are stacked in a thickness direction (the direction of the arrows XA1 and XA2 in FIG. 2) to have an overall ring shape. The metal ring R is not shown in detail in the drawings, but is formed by stacking a plurality of ring members Ra obtained by forming metal boards in a ring shape.

Furthermore, the element 10 includes a head 14 positioned, when the continuously variable transmission belt is formed, on the outer circumferential side (arrow ZA1 side in FIG. 1) of the continuously variable transmission belt and a body 16 positioned, when the continuously variable transmission belt is formed, on the inner circumferential side (arrow ZA2 side in FIG. 1) of the continuously variable transmission belt, as well as a neck 18 that connects the head 14 and the body 16 to form a single body. By causing the neck 18 to be narrower than the head 14 and the body 16, a pair of grooves 20 is formed between the head 14 and the body 16. A metal ring R is sandwiched in each groove 20.

A pulley P of the continuously variable transmission, which is shown by imaginary lines in FIG. 1, slidably contacts the side surface 22 (V surface) at both ends of the body 16 in the width direction (the direction of the arrows YA1 and YA2 in FIG. 1). Furthermore, as shown in FIG. 2, the flat surfaces 24 extending parallel to each other are provided at the ends of the top end side (arrow ZA1 side) of the body 16 in the width direction (the direction of the arrows XA1 and XA2). A body inclined surface 26 is provided on the arrow XA2 side of the body 16 farther on the bottom end side (arrow ZA2 side) than the flat surface 24. The body inclined surface 26 is inclined in a direction to become closer to the arrow XA1 side from the arrow XA2 side, from the arrow ZA1 side toward the arrow ZA2 side. Due to the body inclined surface 26 inclined in this manner, the body 16 includes a thinned portion 30 with a thickness that decreases toward the arrow ZA2 side from a locking edge 28 formed at the boundary between the flat surface 24 and the body inclined surface 26.

As shown in FIG. 2, a recessed portion 32 is formed near the center of the surface of the head 14 on the arrow XA1 side. On the other hand, a projecting portion 34 capable of engaging with the recessed portion 32 is formed near the center of the surface of the head 14 on the arrow XA2 side. For example, the recessed portion 32 has a circular cross-sectional shape, and the projecting portion 34 is formed by a cylindrical protrusion with a circular cross section allowing the projecting portion 34 to enter into the recessed portion 32 while a small space is maintained therebetween. When the continuously variable transmission belt is formed, the positional relationship among the elements 10 is determined by inserting the projecting portions 34 into the recessed portions 32 of elements 10 stacked adjacent to each other.

The following describes the metal sheet molding method (referred to below simply as the "molding method") according to the present embodiment for obtaining the element 10 by molding the metal sheet 12.

Figure 3:
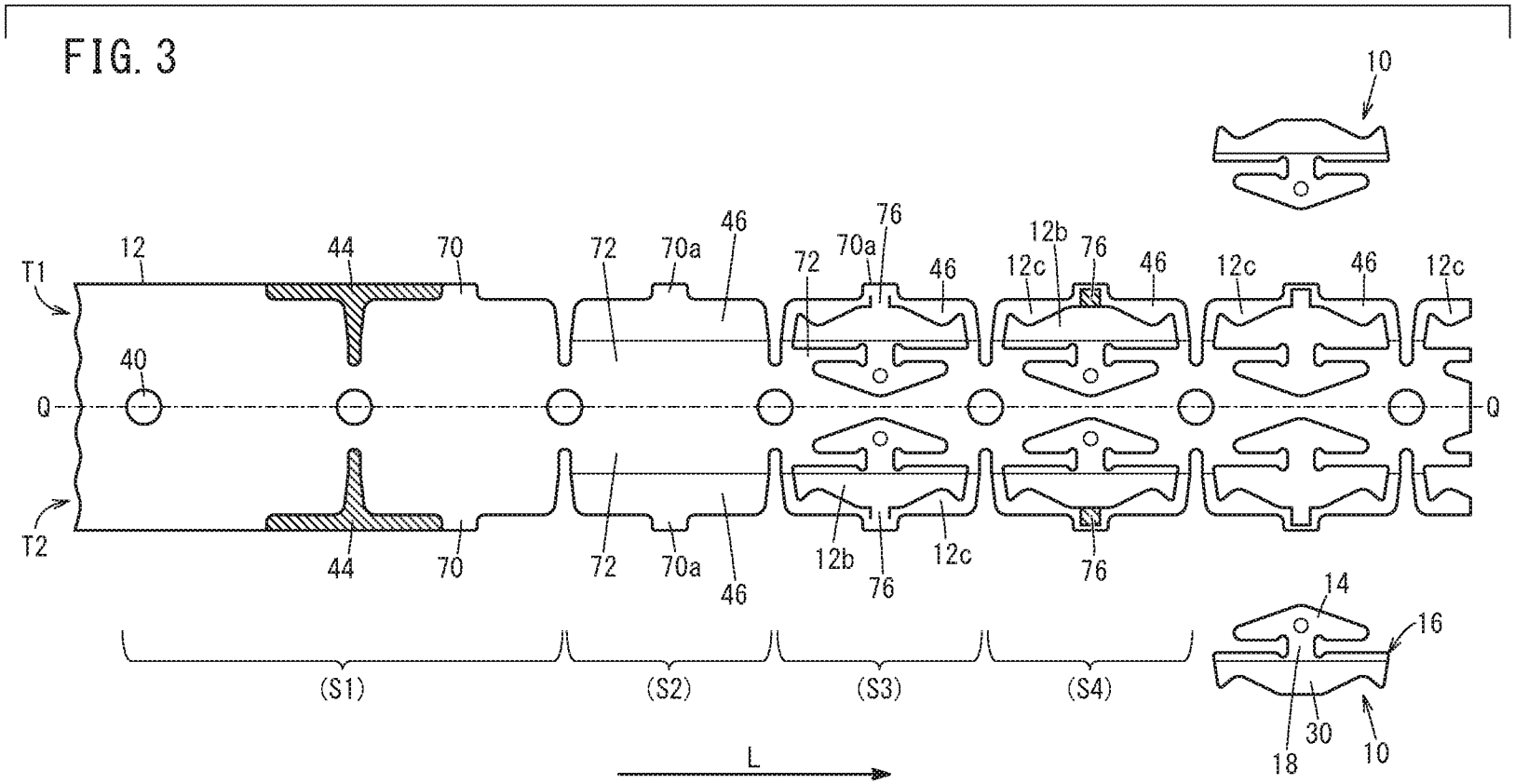
FIG. 3 is a descriptive diagram showing the manufacturing process of the continuously variable transmission element along the longitudinal direction of the metal sheet.
Figure 4:
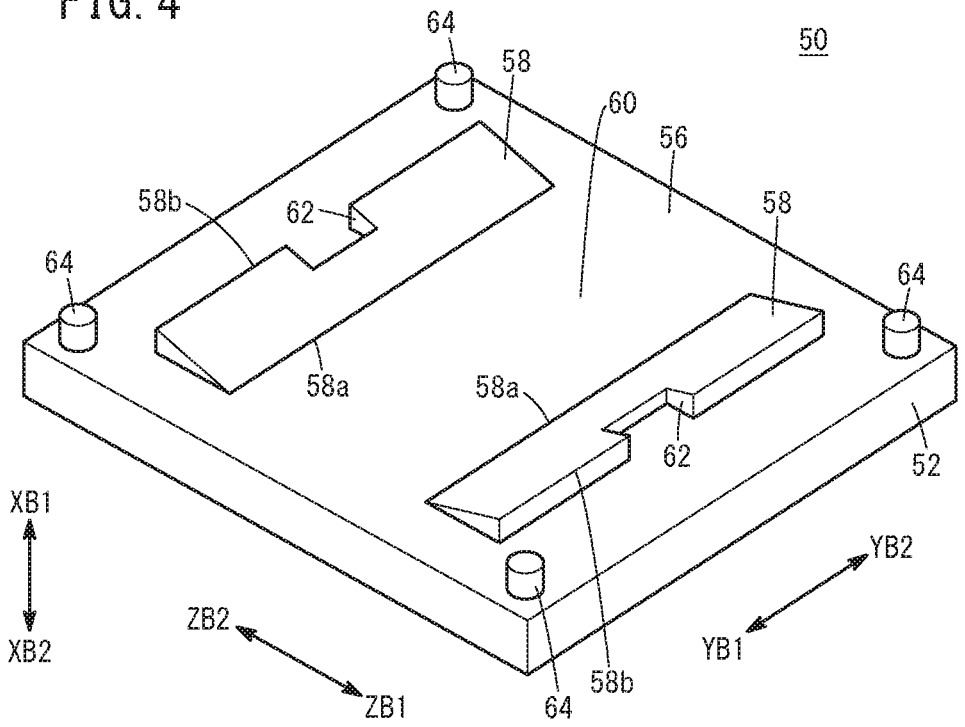
FIG. 4 is a perspective view of the die of the mold apparatus performing the crush machining on the metal sheet.
Figure 5:
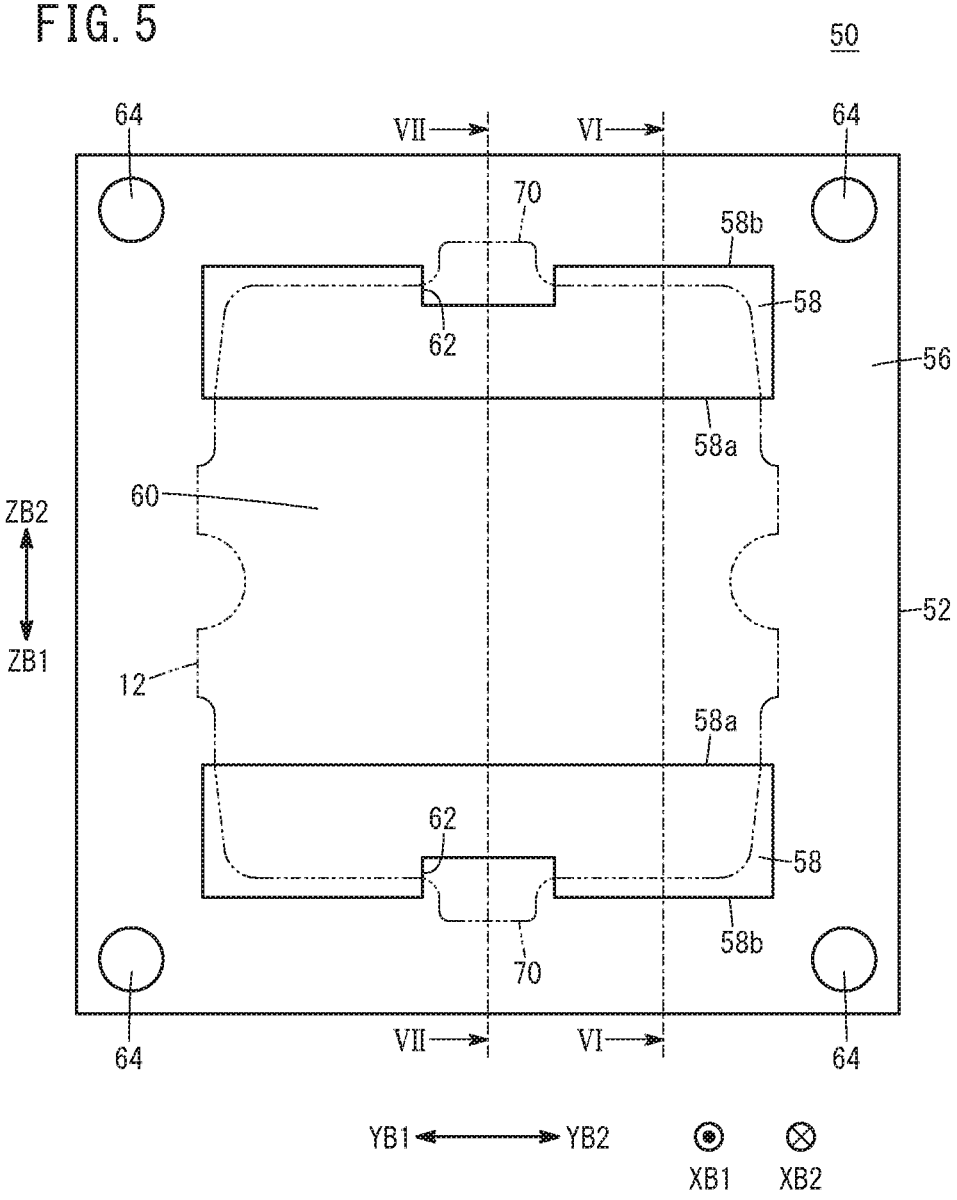
FIG. 5 is a planar view for describing the relationship between the die and the metal sheet mounted on the die.

As shown in FIG. 3, the metal sheet 12 is transported along the arrow L direction and undergoes prescribed machining, described further below, at each of a first machining station S1, a second machining station S2, a third machining station S3, and a fourth machining station S4. Before machining, the metal sheet 12 is formed as a long sheet with a uniform thickness, and is fed out from a roll body (not shown in the drawings) to be transported to each of the machining stations S1, S2, S3, and S4.

In this molding method, machining target portions T1 and T2 in two rows at the sides of a center line Q in the width direction of the metal sheet 12 are provided to the metal sheet 12 and the machining described above is applied to each machining target region T1 and T2, thereby forming the elements 10 with line symmetry where the center line Q is an axis of the line symmetry. Specifically, the elements 10 are formed with the head 14 sides of the elements 10 facing the center line Q, on each side of the center line Q of the metal sheet 12.

The metal sheet 12 is first transported to the front stage of the first machining station S1. At the first machining station S1, first, a pilot hole 40, which is a pierce hole, is formed in the metal sheet 12.

The metal sheet 12 provided with the pilot hole 40 and the like is transported to the rear stage of the first machining station S1 due to the movement of a positioning transport pin (not shown in the drawings) inserted into the pilot hole 40, and is positioned at a prescribed position. Next, window punch machining for removing an unnecessary outline portion 44, shown by the diagonal line pattern in FIG. 3, of the element 10 from the metal sheet 12 is performed. The window punch machining can be performed using a general punch and die (neither of which are shown in the drawings).

Next, the metal sheet 12 is transported to the second machining station S2 due to the movement of the transport pin described above. At the second machining station S2, the crush machining is applied to both end portions of the metal sheet 12 in the width direction to reduce the thickness thereof, thereby forming each reduced-thickness portion 46 corresponding to the thinned portions 30 of the elements 10. This crush processing can be performed using a mold apparatus 50 shown in FIGS. 4 to 9.

The mold apparatus 50 includes a die 52 and a punch 54 (see FIGS. 6 to 9). A pair of inclined surfaces 58 facing each other in the direction of the arrows ZB1 and ZB2 with a space therebetween and a flat surface 60 interposed between the pair of inclined surfaces 58 are provided on a machining surface 56, which is a surface of the die 52 facing the punch 54.

Each inclined surface 58 in the pair includes an inner end portion 58*a* on the side near the flat surface 60 and an outer end portion 58*b* on the side farther away from the flat surface 60, and is inclined in a direction to protrude farther from the flat surface 60, i.e. a direction toward the arrow XB1 side, as each inclined surface 58 extends from the inner end portion 58*a* toward the outer end portion 58*b*. The inclination angle of this inclined surface 58 is set to have a magnitude corresponding to the inclination angle of the body inclined surface 26 of the element 10 to be ultimately obtained. The length of the inclined surface 58 in the longitudinal direction (direction of the arrows YB1 and YB2) substantially corresponds to the width of the element 10. A notched portion 62 that is partially notched from the inclined surface 58 toward the inner end portion 58*a* from the outer end portion 58*b* is formed substantially in the center of the inclined surface 58 in the longitudinal direction.

Furthermore, a plurality of protruding pins 64 that protrude to the arrow XB1 side toward the punch 54 are provided on the machining surface 56 of the die 52, farther toward the outer edge than the inclined surfaces 58. As shown in FIGS. 6 to 9, a plurality of protruding pins 68 that protrude to the arrow XB2 side toward the protruding pins 64 are provided at locations corresponding to the protruding pins 64 of the die 52 on the flat bottom end surface 66 of the punch 54 facing the die 52.

The punch 54 is able to move back and forth in the directions of the arrows XB1 and XB2, in a manner to move toward or move away from the machining surface 56 of the die 52, due to a drive mechanism (not shown in the drawings) such as a hydraulic cylinder, for example. When the punch 54 moves toward the die 52, the protruding pins 64 provided to the die 52 and the protruding pins 68 provided to the punch 54 contact each other, thereby determining the bottom dead center of the punch 54, which is described further below. A space corresponding to the shape of the body 16 of the element 10 in the thickness direction is formed on each of the arrow ZB1 side and the arrow ZB2 side between the bottom end surface 66 of the punch 54 that has reached the bottom dead center and the inclined surfaces 58 and flat surface 60 of the die 52.

When the crush machining is performed using the mold apparatus 50 configured in the manner described above, first, as shown in FIG. 5, a mounting step is performed for mounting the metal sheet 12 on the die 52 in a manner to span over both of the inclined surfaces 58 forming the pair. Due to this, one end portion of the metal sheet 12 in the width direction is mounted on the inclined surface 58 on the arrow ZB1 side, and the other end portion of the metal sheet 12 in the width direction is mounted on the inclined surface 58 on the arrow ZB2 side.

The metal sheet 12 is provided with protruding portions 70 that protrude outward in the width direction (the directions of the arrows ZB1 and ZB2) at substantially the center in the directions of the arrows YB1 and YB2 of the portion mounted on the inclined surfaces 58 in the manner described above. These protruding portions 70 are arranged within the notched portions 62 of the inclined surfaces 58.

Figure 6:
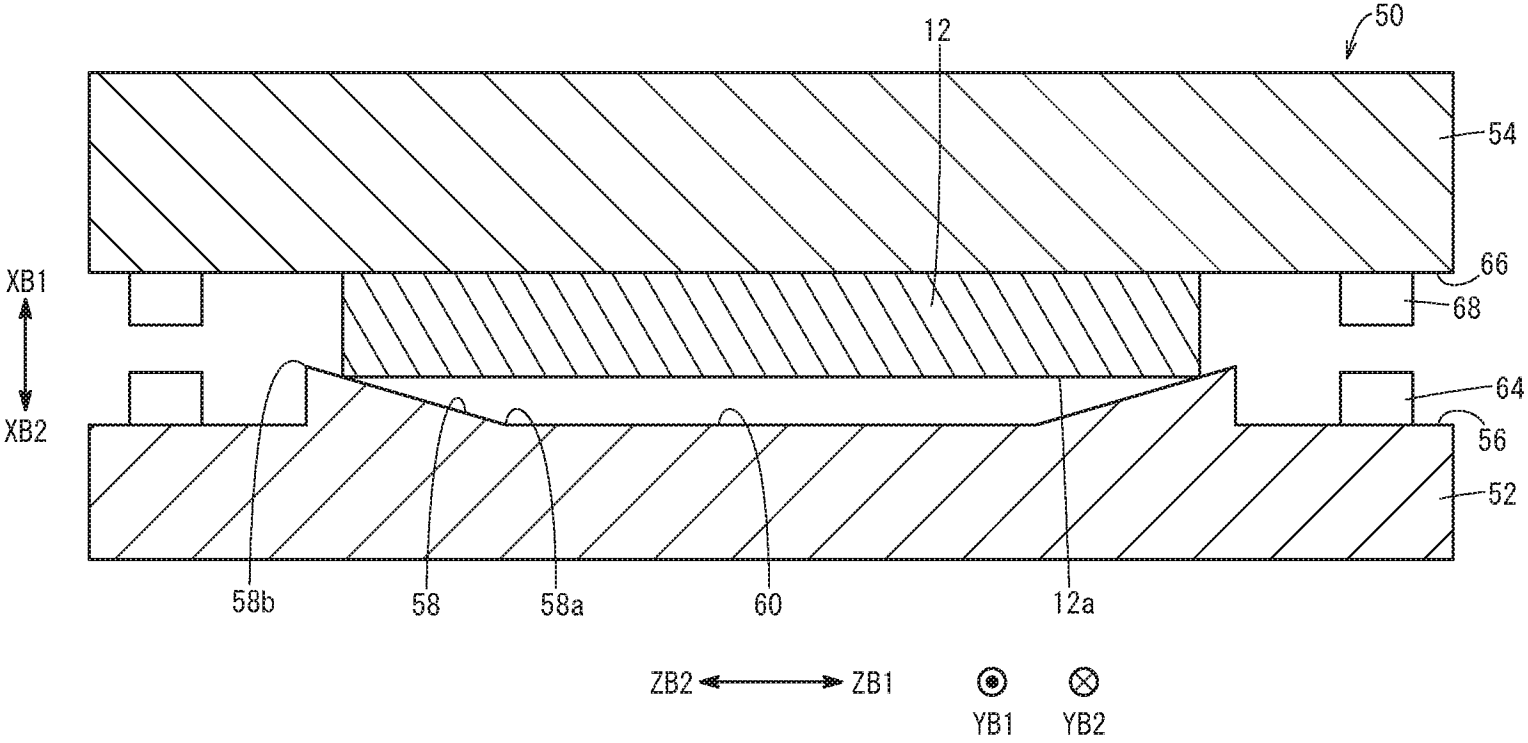
FIG. 6 is a descriptive diagram for describing the state in which the punch contacts the metal sheet, in the cross section over the line VI-VI of FIG. 5.
Figure 7:
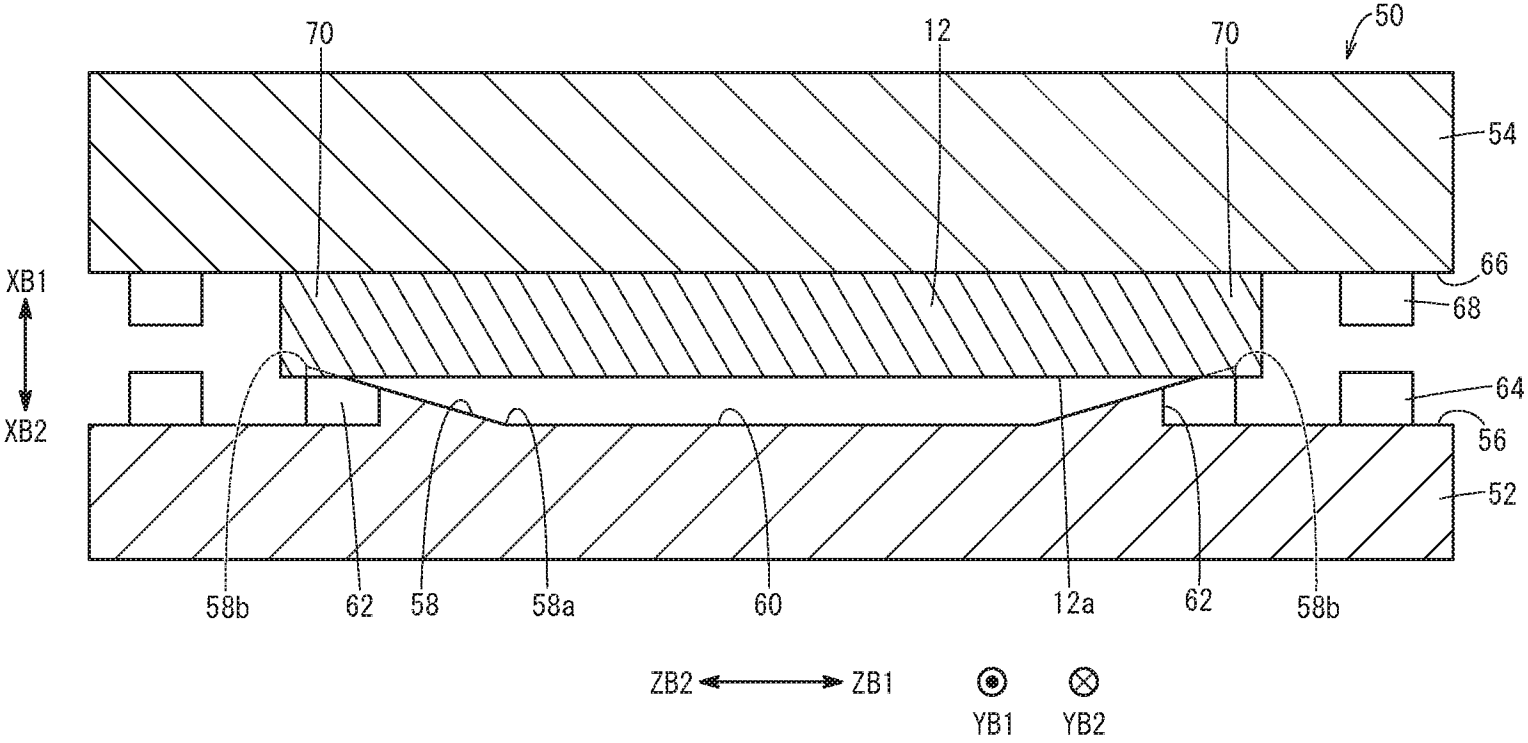
FIG. 7 is a descriptive diagram for describing the state in which the punch contacts the metal sheet, in the cross section over the line VII-VII of FIG. 5.

Next, as shown in FIG. 6 to FIG. 9, the die 52 is brought near the punch 54 and the metal sheet 12 is pressed between each of the inclined surfaces 58 forming the pair and the bottom end surface 66 of the punch 54, thereby performing a pressing step for forming the reduced-thickness portions 46 at the end portions of the metal sheet 12 in the width direction. Specifically, in the pressing step, by lowering the punch 54 toward the die 52, the end portions of the metal sheet 12 in the width direction, excluding the protruding portions 70, are sandwiched between the bottom end surface 66 of the punch 54 and the inclined surfaces 58 of the die 52, as shown in FIG. 6 and FIG. 7.

Furthermore, by lowering the punch 54, the end portions of the metal sheet 12 in the width direction, excluding the protruding portions 70, are pressed between the inclined surfaces 58 of the die 52 and the bottom end surface 66 of the punch 54, thereby reducing the thickness of these end portions. At this time, the distance between the inclined surfaces 58 of the die 52 and the bottom end surface 66 of the punch 54 differs in each region according to the inclination angle of the inclined surfaces 58, and therefore the magnitude of the pressing force applied to the end portions of the metal sheet 12 in the width direction (the inclined wall contact portions) being pressed between the inclined surfaces 58 of the die 52 and the bottom end surface 66 of the punch 54 also differs in each region. Due to this, at the end portions of the metal sheet 12 in the width direction, the thickness is reduced as matter flows along the surface direction of the machining surface 56 of the die 52.

Figure 8:
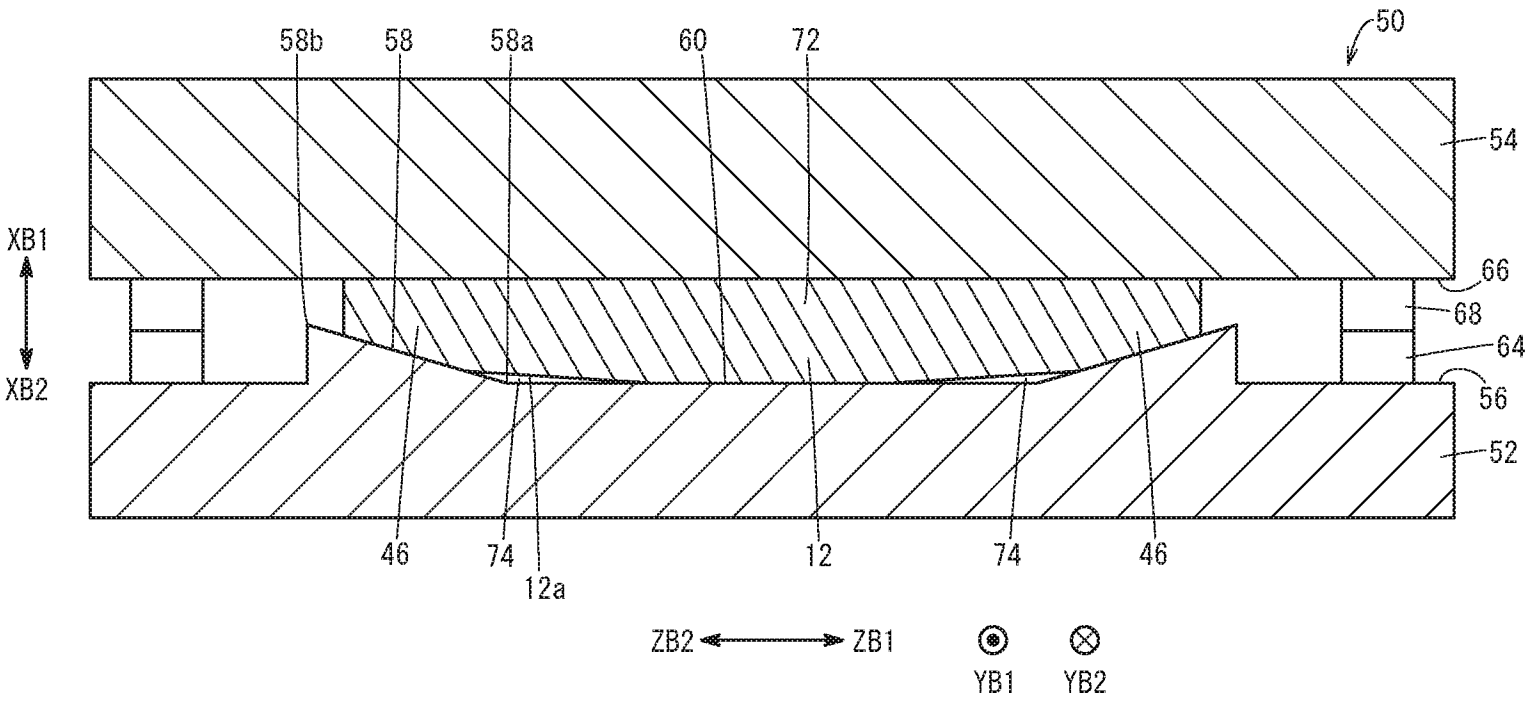
FIG. 8 is a descriptive diagram for describing the state in which the die and the punch of FIG. 6 are clamped.
Figure 9:
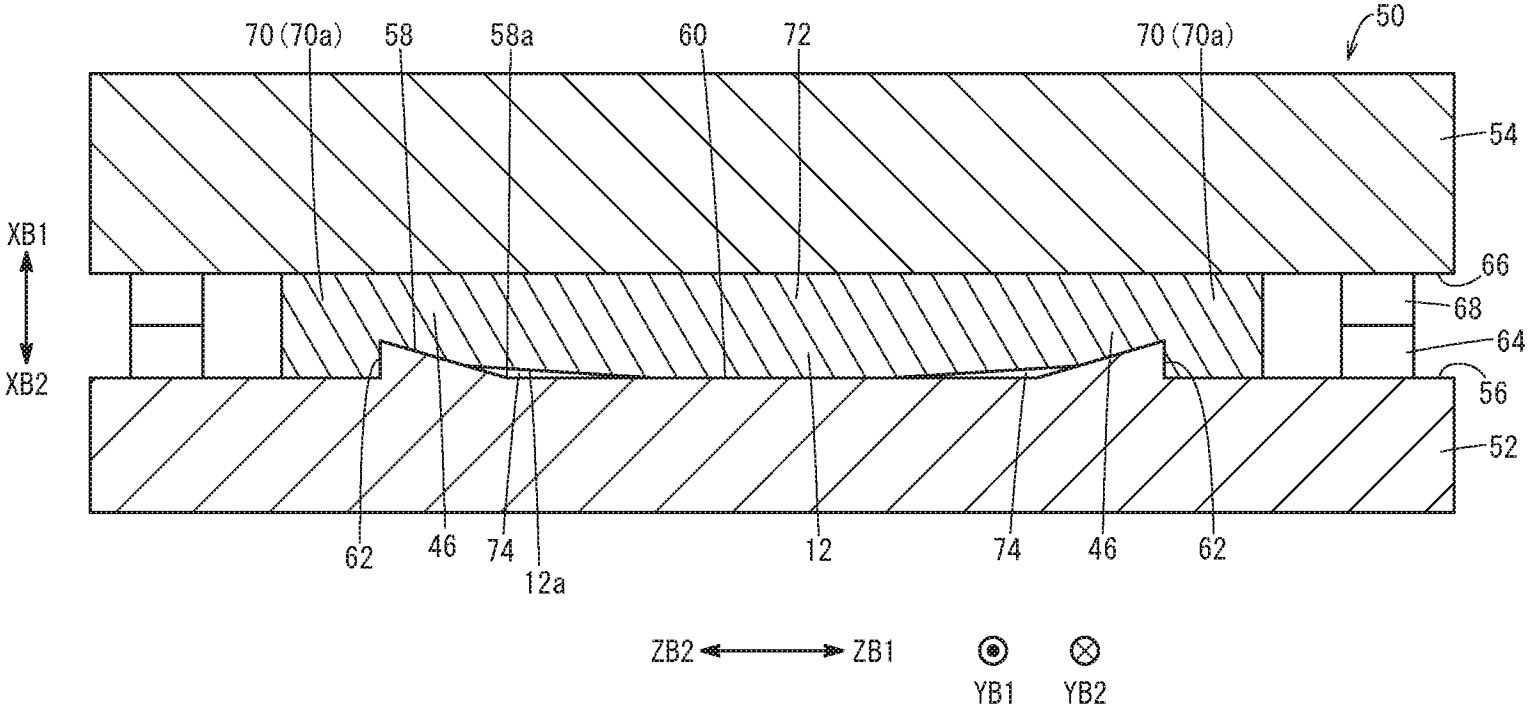
FIG. 9 is a descriptive diagram for describing the state in which the die and the punch of FIG. 7 are clamped.

Then, as shown in FIG. 8 and FIG. 9, at the moment when the protruding pins 64 of the die 52 contact the protruding pins 68 of the punch 54, the punch 54 is prevented from being lowered any farther, and the reduced-thickness portions 46 are formed at the end portions of the metal sheet 12 in the width direction, excluding the protruding portions 70. Furthermore, as shown in FIG. 9, the protruding portions 70 provided within the notched portions 62 do not have their thickness reduced, and instead form thick portions 70*a* that are thicker than the reduced-thickness portions 46. It should be noted that the thick portions 70*a* may be formed by reducing the thickness of the protruding portions 70 by an amount that is less than thickness reduction of the reduced-thickness portions 46, by adjusting the depths of the notched portions 62 or the like.

Furthermore, a flat portion 72 corresponding to the thickness on the head 14 side of the locking edge 28 of the element 10 is formed in a portion of the metal sheet 12 interposed between the flat surface 60 of the die 52 and the bottom end surface 66 of the punch 54.

The bottom dead center of the punch 54 in this pressing step is set in a manner to maintain a state in which a gap 74 is formed between the inner end portion 58*a* and the surface 12*a* of the metal sheet 12 facing the inner end portion 58*a*.

Next, as shown in FIG. 3, the metal sheet 12 is transported to the third machining station S3 due to the movement of the transport pin described above. At the third machining station S3, a punching step is performed to apply punch machining to the metal sheet 12, while leaving behind the thick portion 70*a*. Due to this, the portion of the metal sheet 12 excluding the thick portion 70*a* is punched to have the outline shape of the element 10, and a connecting portion 76 that connects the punched portion 12*b* and the remaining portion 12*c* of the metal sheet 12 is formed for the thick portion 70*a*.

As a result, the outer circumference of the thinned portion 30 of the element 10 is cut out of the reduced-thickness portion 46 of the metal sheet 12 where the thickness has been reduced by the crush machining, and the outer circumference of the portion that stretches from the locking edge 28 to the head 14 of the element 10 is cut out of the flat portion 72 of the metal sheet 12. It should be noted that such a punching step can be performed using the machining apparatus recorded in Japanese Laid-Open Patent Publication No. 2016-124020, for example.

Next, the metal sheet 12 is transported to the fourth machining station S4, due to the movement of the transport pin described above. At the fourth machining station S4, a separation step is performed for separating the element 10 from the remaining portion 12*c* of the metal sheet 12, by punching and severing the connecting portion 76. Due to this, it is possible to obtain an element 10 including a body 16 in which the thinned portion 30 is formed, from each machining target portion T1 and T2 of the metal sheet 12.

From the above, in the pressing step of the molding method according to the present embodiment, as shown in FIG. 8 and FIG. 9, the bottom dead center of the punch 54 and the die 52 is set in a manner to maintain a state in which a gap 74 is formed between the inner end portions 58*a* of the inclined surfaces 58 and the surface 12*a* of the metal sheet 12. Therefore, even when matter flows along the surface direction of the machining surface 56 (the inclined surfaces 58 and flat surface 60) of the die 52 at the end portions of the metal sheet 12 in the width direction as described above, this matter can flow into the gap 74. By making it possible for the matter to favorably flow between the inclined surfaces 58 and flat surface 60 of the die 52 and the bottom end surface 66 of the punch 54 in this manner, it is possible to form the reduced-thickness portions 46 at the end portions of the metal sheet 12 in the width direction while the occurrence of uneven thickness or the like in the surface of the metal sheet 12 is avoided.

Accordingly, with this molding method, it is possible to form the reduced-thickness portions 46 by applying crush machining to the metal sheet 12, while restricting the occurrence of uneven thickness or the like in the surface. By forming the thinned portion 30 from these reduced-thickness portions 46 and forming the head 14 side beyond the locking edge 28 from the flat portion 72 of the metal sheet 12, it is possible to obtain a high-quality element 10.

Furthermore, in this molding method, as described above, due to the simple configuration of providing the inclined surfaces 58 with the notched portions 62, it is possible to form the thick portions 70*a*, which are thicker than the reduced-thickness portions 46, at portions of the metal sheet 12 other than the flat portion 72, i.e. at the width-direction end portions of the metal sheet 12 provided with the reduced thickness portions 46.

In the manner described above, in the punching step in this molding method, at least part of the thick portion 70*a* is left behind and the punch machining is applied to the metal sheet 12. Due to this, it is possible to form the connecting portion 76 that connects the punched portion 12*b* forming the element 10 of the metal sheet 12 and the remaining portion 12*c*, at the thick portion 70*a* that remains without being punched. At this time, due to the thick portion 70*a* having a sufficient thickness, the connecting portion 76 can be formed easily.

By severing this connecting portion 76 in the separation step after the punching step, it is possible to separate the element 10 from the remaining portion 12*c* of the metal sheet 12. In this way, by performing the punching step and the separation step as separate steps, it is possible to obtain the element 10 efficiently and with high accuracy.

The present invention is not limited to the embodiments described above, and various alterations can be made to the above-described embodiments without deviating from the technical scope of the present invention.

In the embodiments described above, one notched portion 62 is provided substantially in the center of each inclined surface 58 in the longitudinal direction (the direction of the arrows YB1 and YB2) and the thick portions 70*a* are provided in the protruding portions 70 of the metal sheet 12, but the present invention is not particularly limited to this. The number of thick portions 70*a* provided and the locations where the thick portions 70*a* are provided can be set as appropriate in a manner to obtain a molded item with the desired shape. Furthermore, it is acceptable for the notched portions 62 to not be provided in the inclined surfaces 58, so that the thick portions 70*a* are not formed in the metal sheet 12.

Furthermore, in the embodiments described above, the bottom dead center of the punch 54 is set in the manner described above by adjusting the contact position between the protruding pins 64 that protrude from the machining surface 56 of the die 52 and the protruding pins 68 that protrude from the bottom end surface 66 of the punch 54, but the present invention is not particularly limited to this. A known configuration of a stroke end block or the like (not shown in the drawings), for example, can be adopted as the configuration for setting the bottom dead center of the punch 54.

What is claimed is:

1. A molding method of a metal sheet for obtaining a molded item including a reduced-thickness portion where thickness is reduced by applying crush machining to the metal sheet using a punch and a die, wherein a machining surface of the die is provided:

with a pair of inclined surfaces facing each other across a gap, and a flat surface interposed between the pair of inclined surfaces, wherein each inclined surface in the pair:

comprises an inner end portion on a side near the flat surface and an outer end portion on a side farther away from the flat surface, and is inclined in a direction to protrude farther from the flat surface from the inner end portion toward the outer end portion, and comprises a notched portion formed in the inclined surface in a longitudinal direction, wherein the molding method comprises:

a mounting step of mounting the metal sheet on the die in a manner to span both of the inclined surfaces in the pair, and a pressing step of forming a reduced-thickness portion by bringing the punch close to the die and pressing the metal sheet between the punch and each of the inclined surfaces in the pair, wherein the pressing step comprises setting a bottom dead center of the punch in a manner to maintain a state in which a gap is formed between the inner end portion and a surface of the metal sheet facing the inner end portion, wherein the molded item comprises a continuously variable transmission element that comprises:

a body having a thinned portion and a side surface that slides on a rib of a continuously variable transmission, a neck that protrudes from a top end portion of the body, and a head that is wider than the neck and connected to the neck, wherein the continuously variable transmission element sandwiches a metal belt between the body and the head, wherein the mounting step and the pressing step comprises forming the thinned portion as the reduced-thickness portion, wherein the notched portion is formed in each inclined surface from the outer end portion toward the inner end portion, and wherein the molding method further comprises a punching step for punching an outline shape of the continuously variable transmission element in the metal sheet, while leaving behind at least part of thick portions formed in the pressing step to be thicker than the reduced-thickness portion, by mounting the thick portions at a position facing the notched portions in the mounting step.

2. The metal sheet molding method according to claim 1, wherein the notched portion is formed in a center of each inclined surface from the outer end portion toward the inner end portion, and wherein the mounting step comprises mounting the metal sheet on the die such that a location where thick portions, which are thicker than the reduced-thickness portion of the metal sheet, are formed faces the notched portions.

* * * * *